United States Patent [19]

Gustavsson

[11] Patent Number: 4,491,079

[45] Date of Patent: Jan. 1, 1985

[54] DEVICE FOR FOLDING AND MAKING A HEM ON THE END EDGES OF A PIECE OF CLOTH, E.G. A SHEET

[75] Inventor: Pertti Gustavsson, Horred, Sweden

[73] Assignee: Akab of Sweden AB, Boras, Sweden

[21] Appl. No.: 450,150

[22] Filed: Dec. 15, 1982

[51] Int. Cl.[3] ..... D05B 21/00; D05B 35/02

[52] U.S. Cl. ..... 112/121.15; 112/121.29; 112/143; 112/130; 112/307

[58] Field of Search ..... 112/121.15, 121.12, 112/143, 141, 147, 153, 136, 130, 121-129, 304, 307

[56] References Cited

U.S. PATENT DOCUMENTS

| | | | |
|---|---|---|---|
| 2,546,831 | 3/1951 | Newell | 112/121.15 |
| 2,738,746 | 3/1956 | MacIsaac, Jr. et al. | 112/304 X |
| 2,740,457 | 4/1956 | Wood et al. | 112/147 X |
| 3,489,113 | 1/1970 | Flanagan | 112/147 X |
| 3,640,235 | 2/1972 | Burton | 112/147 |
| 3,773,002 | 11/1973 | Burton | 112/121.29 X |
| 3,906,878 | 9/1975 | Burton | 112/121.29 X |
| 3,963,548 | 6/1976 | George et al. | 112/143 X |
| 4,154,180 | 5/1979 | Burton | 112/121.29 X |

*Primary Examiner*—H. Hampton Hunter
*Attorney, Agent, or Firm*—Holman & Stern

[57] ABSTRACT

A device for mechanically producing folded hems on the end edges of a piece of cloth detached from a length of fabric, and comprising (a) means for folding the forward end edge of the fabric, corresponding to the folded-in part of the hem to be, over the edge of a delivery member, (b) a gripper arranged on a coiler plate, which is advanced to the delivery edge to grip the fold of the fabric thus that the folded-in part is pressed to contact against the fabric, (c) means for rotating the coiler plate and the fabric fixed therto substantially half a turn, thus that at least a part of the width of the hem to be, is located on a second conveyor track for feeding the piece of cloth to a sewing machine, (d) a holding device pressing the hem against the second conveyor track, while the coiler plate is pulled out of the hem, and (e) an arresting device pressing an inner portion of the fabric against a first track and the delivery member a piece of cloth is detached, each one of the end edges of said piece of cloth which are located on the conveyor tracks being fed towards a sewing machine each. By making the gripper displaceable within the coiler plate's plane the width of one of the hems can easily by adjusted.

11 Claims, 8 Drawing Figures

DEVICE FOR FOLDING AND MAKING A HEM ON THE END EDGES OF A PIECE OF CLOTH, E.G. A SHEET

The present invention refers to a device for mechanically folding and making a hem along two opposite edges on a piece of cloth detachable from a fabric, whereby the width of one of the hems is variable.

BACKGROUND OF THE INVENTION

At known mechanical hemming machines it is not possible in a simple manner to adjust the machine thus that one of the hems will be wider than the other, which is a practical as well as esthetical desire.

THE PURPOSE AND MOST ESSENTIAL FEATURES OF THE INVENTION

The purpose of the present invention is to provide a device for folding and making a hem on opposite end edges of pieces of cloth such as sheets. Another purpose is to make it possible to easily give the length of the hem can be a desired width. This has been obtained by a device comprising an apparatus for mechanically folding and making hems along two opposite edges of a piece of cloth detachable from a roll of fabric, a first and second conveyor tracks, endless, spaced apart, and parallel;

holding and arresting means comprising devices cooperating with said conveyor tracks and extending over the entire width of the fabric, for squeezing portions of the fabric against said conveyor tracks;

a transfer carriage provided between the two conveyor tracks and equipped with a horizontal coiler plate;

said coiler plate being rotatable about a horizontal axis substantially 180 degrees and having rotation means operatively associated therewith;

a fabric gripper means supported upon said coiler plate having gripping operating means associated therewith, which fabric gripper means is arranged to grip a forward end edge of the fabric when it is positioned in a first position adjacent the first conveyor track;

whereby when said coiler plate and supported gripper means is rotated to a position on the opposite side of said horizontal axis said gripped froward end edge of the fabric is conveyed to a second position wherein it is located on the second conveyor track; and whereby said fabric while still engaged by said holding and arresting devices is conveyed by said conveyor tracks to sewing means comprising a sewing machine for each hemmed end edge.

By making the fabric gripper means displaceable within the coiler plate's plane the width of one of the hems can be adjusted.

DESCRIPTION OF EMBODIMENTS

Figure 1:
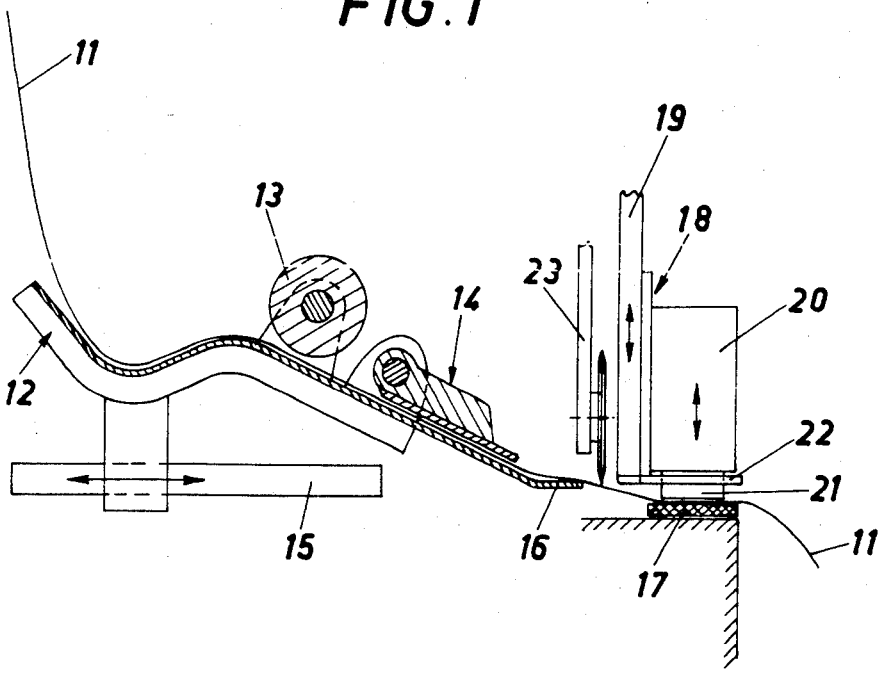
FIG. 1 shows very schematically a section through a part of the hemming machine and more exactly its pulling carriage and one or two holding and arresting devicesm.

The invention will now be described with reference to the embodiment shown in FIGS. 1-5. The hemming machine has a length corresponding to the largest occuring width of the fabric e.g. a single or double sheet. The fabric 11, which is wound on a not further shown roller, is via guide and drawing rollers (not shown) fed to a pulling carriage 12, on which is arranged at one hand a feed roller 13 and on the other hand a squeezing device 14. The pulling carriage 12 is displaceable in the horizontal plane along guides 15, whereby the tongue 16 of the squeezing device can be moved past a first endless conveyor track 17. This is intended to convey the rear end of a piece of cloth detached from the fabric to a sewing machine for hemming.

An arresting device 18 is arranged just in front of the first conveyor track 17 and it is displaceable to and from this. At the stand 19 of the arresting device 18 there is supported a pressing device 20, which is moveable vertically relative to the stand and which has a plurality of rubber blocks 21, which can be brought to press the fabric 11 to engagement against the conveyor track 17. The rubber blocks 21 pass through openings in a presser base 22, which is connected to the stand 19 and which, when a holding is desired, can be brought to engagement against the conveyor track, and which gives less friction than the rubber blocks. In the space between the first conveyor track 17 and the tongue 16 of the squeezing device it is possible to introduce a cutting device 23 by means of which it is possible to detach a piece of cloth or a strip of cloth, e.g. if the edge of the cloth shall be cut clean from the fabric 11. During the cutting the fabric is squeezed at one hand by an arresting device 18 against the immobile conveyor track 17 and on the other hand by the squeezing device 14.

The cutting device 23 is located thus in relation to the tongue 16 that the forward end edge of the fabrid after being cut will hang over the tongue 16 of the squeezing device so much that a suitable folding-in part 37 is formed.

After the cutting by means of the cutting device 23 the arresting device 18 is displaced vertically upwards so much that a transfer carriage 24 located by the side thereof can come into action. The transfer carriage 24 consists of a coiler plate 25, which extends over the entire machine length and at which plate there is arranged on one side a gripper 26 and on the other side a driver device 27, which under influence of a guide member 28 can give the gripper 26 a displacement movement in the plane of the coiler plate. The coiler plate 25 is rotatable 180 degrees about the axis 29 by means of a not further shown driving device. The transfer carriage 4 is displaceable along guides 30 in the horizontal plane by means of an appropriate driving device, e.g. a pneumatic piston cylinder of which has been only intimated the piston stem 31 in FIG. 2.

The guiding member 28 is on one hand carried by the transfer carriage 24 and will therefore make the same horizontal movements as this and on the other hand it is displaceable relative to the transfer carriage by means of a separate driving device (not shown), the motion path of which can be manually adjusted by means of a handle 32.

Figure 2:
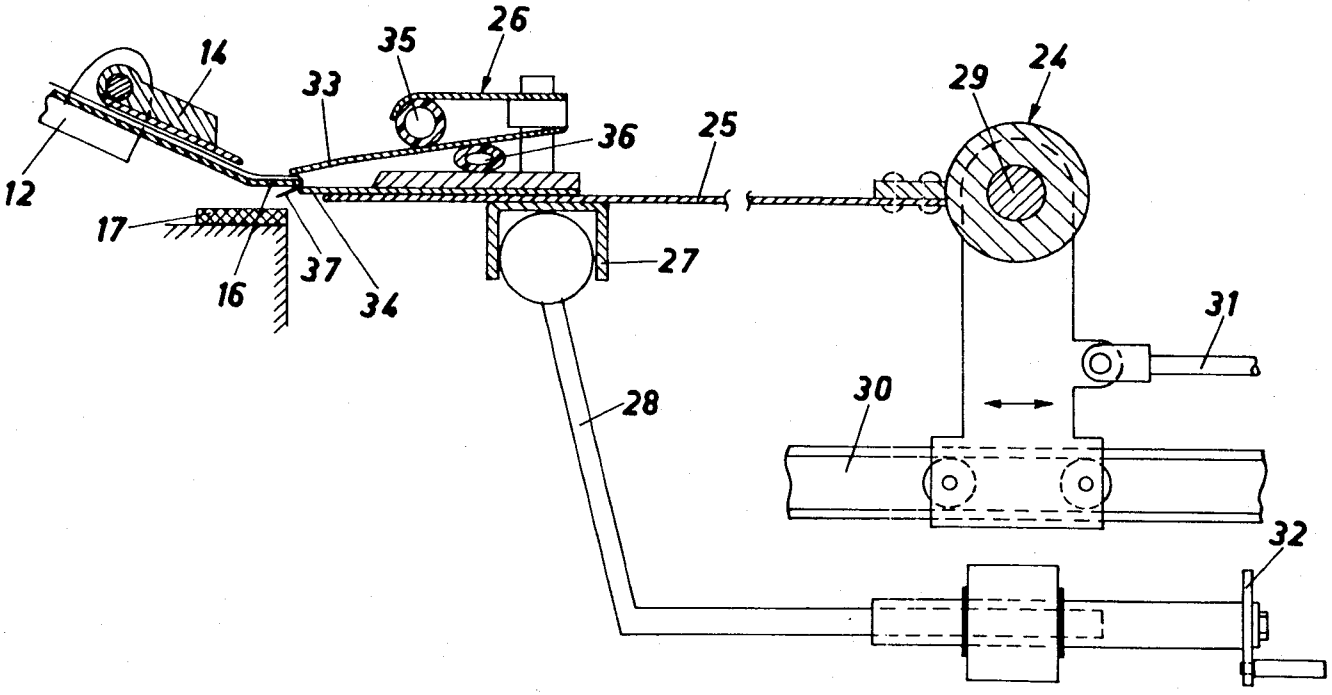
FIG. 2 shows a section through the forward end of the pulling carriage and a transfer carriage with a gripper cooperating therewith.

The gripper 26 consists of an upper and a lower gripper plate 33, 34, which by means of pneumatically inflateable rubber hoses 35 and 36 can grip around an object along its entire length. In FIG. 2 is shown how the gripper is beginning to squeeze the forward edge of the fabric which is hanging freely over the tongue 16 between its gripper plates 33, 34 in such manner that a folded-in part 3 is formed. In order to allow the gripper to be able to grip the forward end edge of the fabric the pulling carriage 12 has been displaced along the guides 15 so far that the tongue 16 of the squeezing device 14 extends over the conveyor track 17. When the forward end edge of the fabric and the folded in part 37 have been squeezed in the gripper 26 it is possible to displace the transfer carriage 24 in a direction away from the conveyor track 17 at the same time as the guiding member 28 is displaced on the coiler plate 25 so far as allowed by the position of the handle 32. From this position shown in FIG. 3 it is possible for the transfer carriage to rotate the coiler plate 25 through 180 degrees, whereby its forward end portion will be located on a second endless conveyor track 38, which is shown in FIG. 4.

Figure 3:
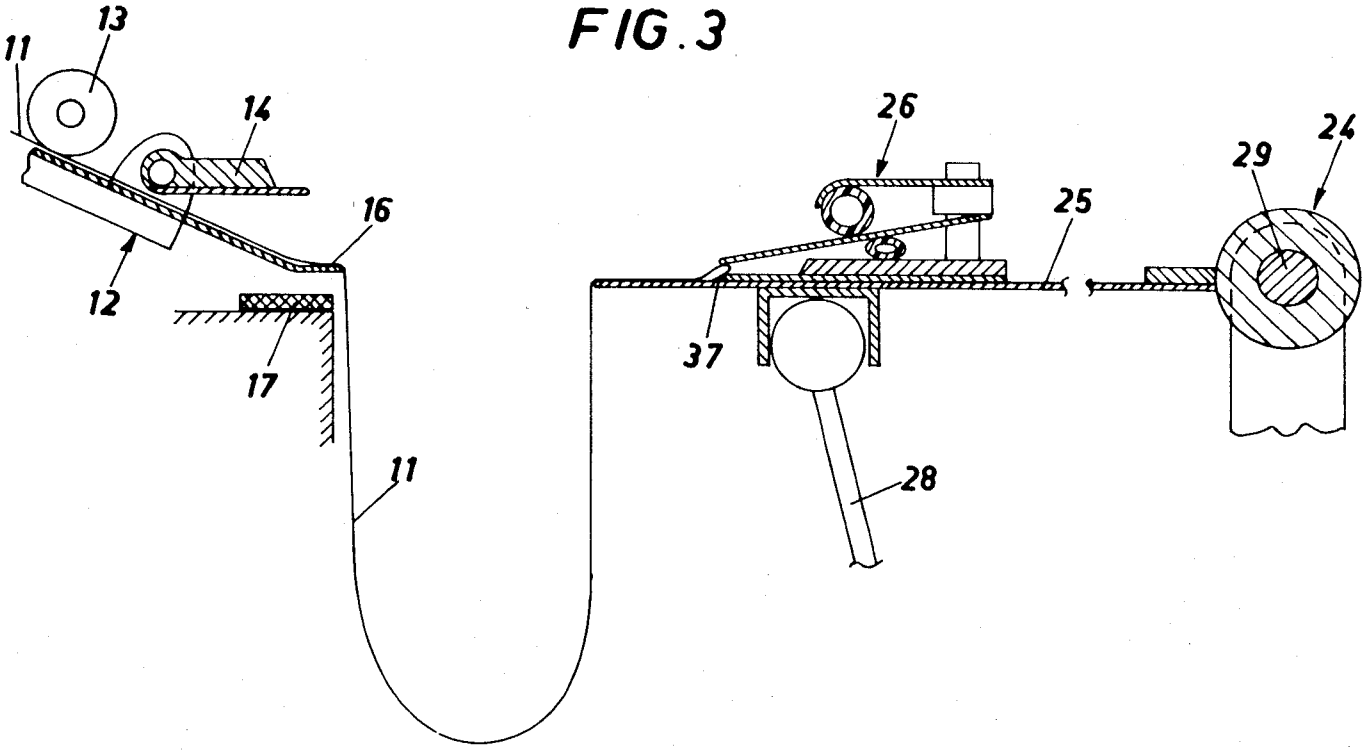
FIG. 3 is a section analogous with FIG. 2 but the transfer carriage and the gripper are shown in a position displaced laterally.
Figure 4:
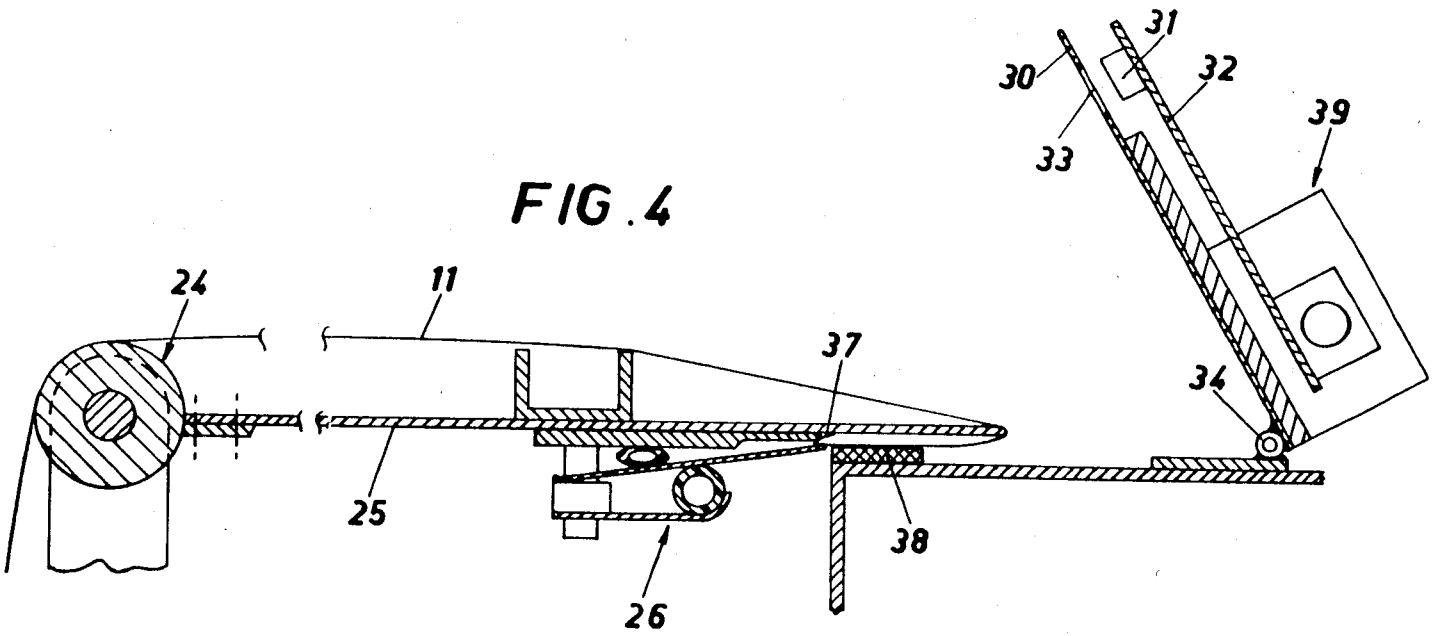
FIG. 4 shows a section through the transfer carriage in a position turned 180 degrees relative to FIGS. 2 and 3, the carriage thereby cooperationg with a first conveyor track.

The side displacement of the gripper 26 from the collection position to the position shown in FIG. 3 corresponds to the length of the hem and it is manually adjustable with said handle 32. Also the displacement of the transfer carriage 24 along the guides 30 is adapted so that the coiler plate 25 in its delivery position according to FIG. 4 extends so far over the conveyor track 38 that an essential part of the hem to be, except the outer end edge with the folded-in part, is located over the conveyor track 38.

Adjacent the conveyor track 38 is arranged a holding device 39, which in the same manner as the arresting device 18 is provided with two squeezing devices, which are independent of each other, and which more correctly are a first pressure plate 30 and a second pressure plate 32 provided with rubber blocks 31 and arranged at some distance from and above the first pressure plate 30. In this plate is made openings 33 for the passage of the rubber blocks 31 and depending on if it is desired a retention without friction it is possible to activate one or the other of the pressure plates. The means for the rotation of the holding device and thereby the plate 30 against the conveyor track about the axis 34 and also for the movement of the pressure plate 32 are not further shown on the drawing but they consist of appropriate driving devices, e.g. pneumatical piston engines.

Figure 6:
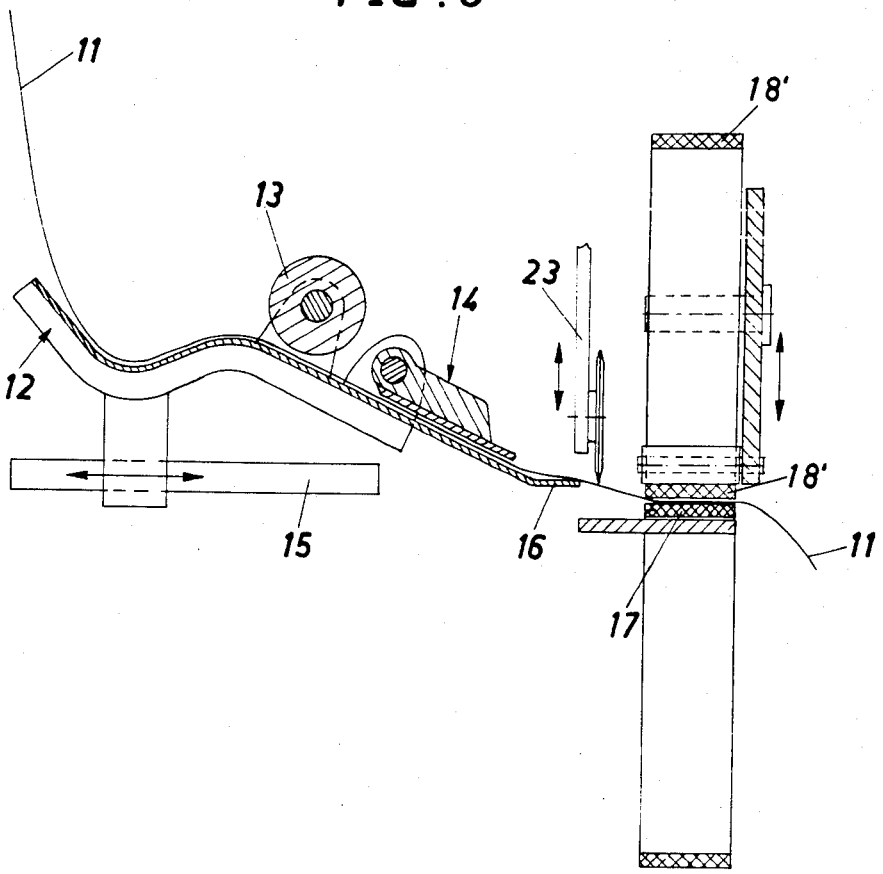
FIG. 6 shows a section analogous with FIG. 1 but of a modified embodiment of the hemming machine.
Figure 7:
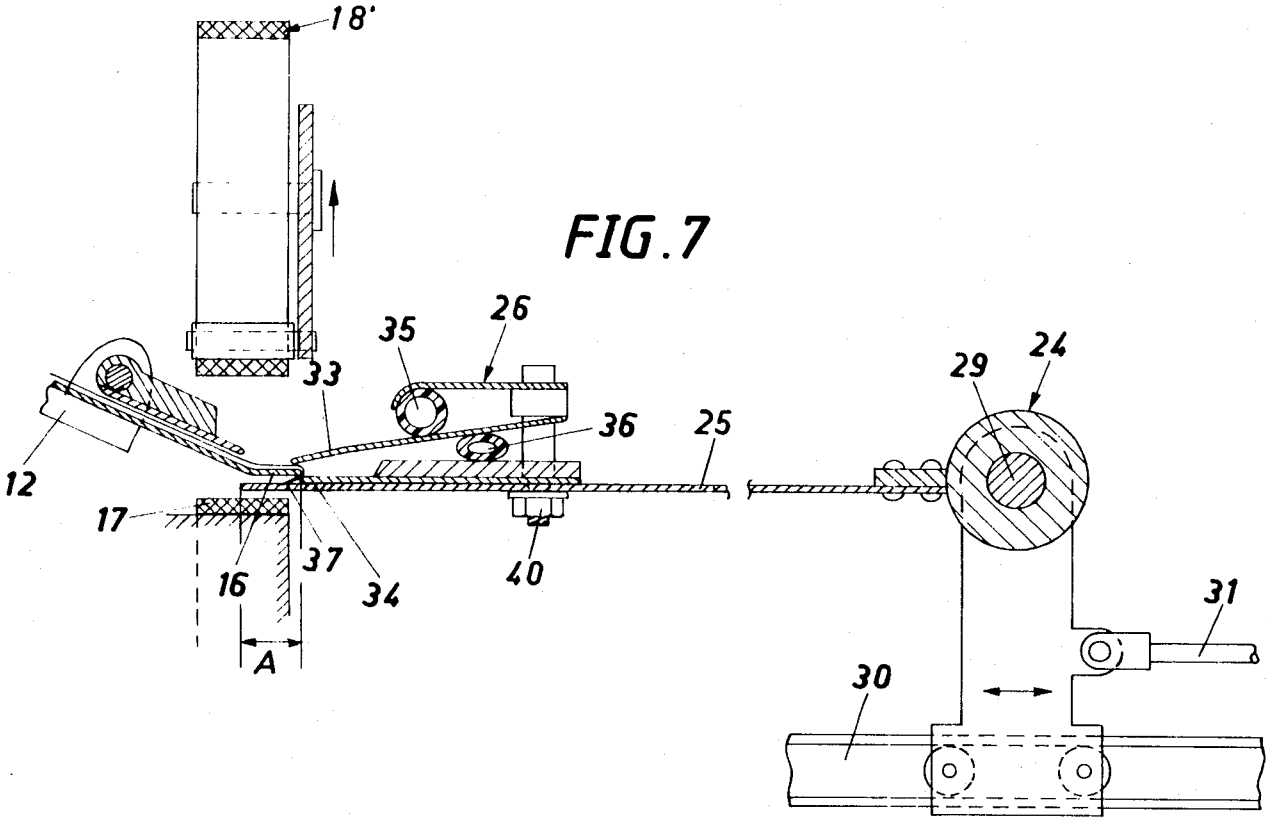
FIG. 7 shows a section analogous with FIG. 2 but of the embodiment according to FIG. 6.
Figure 8:
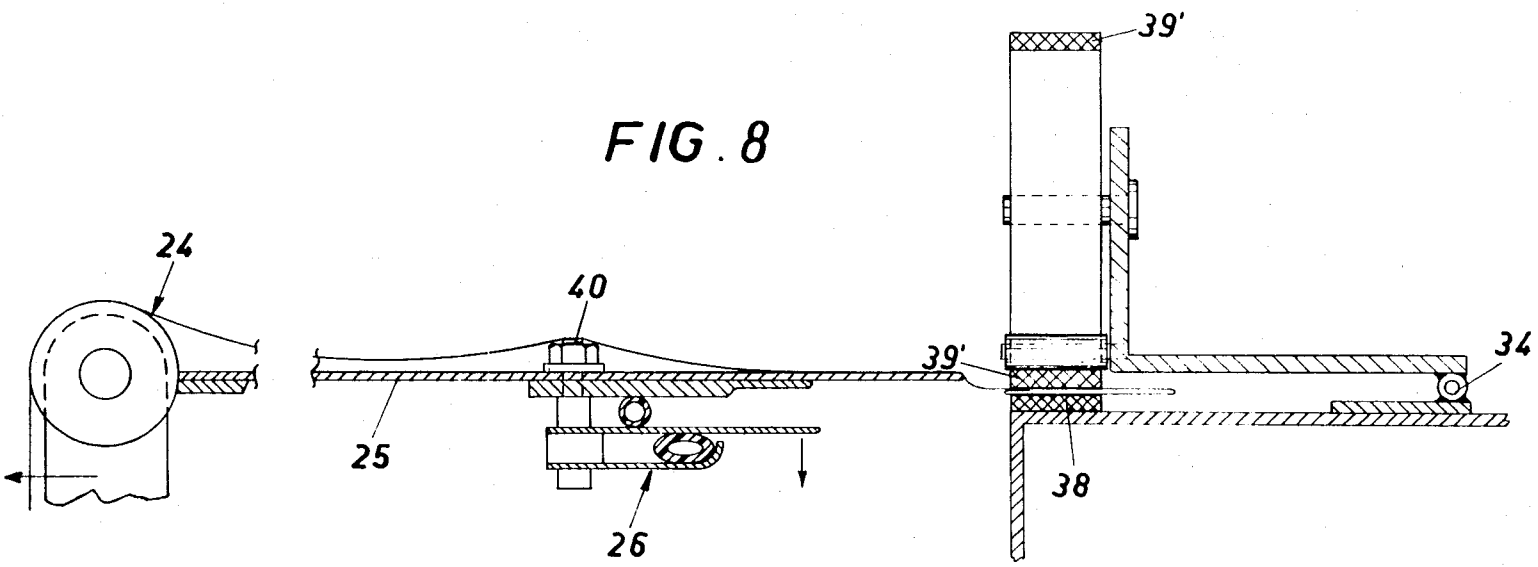
FIG. 8 shows a section analogous with FIG. 5 but of the embodiment according to FIGS. 6 and 7.

According to the modified embodiment shown in FIGS. 6–8 the arresting means 18' comprises an endless band pressing the fabric against the conveyor track 17. Likewise the holding device 39' (FIG. 8) comprises an endless band.

Further the driving device 27 with guide member 28 have been eliminated and the gripper 26 is screwed on the coiler plate 25. The screw(s) 40 can be displaced along the coiler plate 25. The coiler plate 25 projects a certain distance in front of the gripper plates 33, 34, said distance A (FIG. 2) corresponding to the width of the hem. The distance A and thus the width of the hem can be adjusted by displacing the screw(s) 40 along the coiler plate 25. It would of course be possible to eliminate the displaceability of the screw(s) 40 if there is no need to vary the width of the hem.

DESCRIPTION OF THE FUNCTION

The forward end edge of the fabric 11 is advanced so far that it will be located over the first conveyor track 17 against which the end of the fabric will be pressed by means of an arresting device 18—FIG. 1. As a safe retention is desired the pressing device 20 with the rubber block 21 will be activated. At the same time the squeezing device 14 will come into function, whereby the forward portion of the fabric will be firmly retained two retention members.

The pulling carriage 12 is displaced somewhat in a direction away from the conveyor track 17, whereby the fabric is streched. A cutting device 23 is moved over the stretched fabric and will detach the forward end portion thereof, i.e. the fabric will be cut clean. Thereby is formed an end edge, which will hang freely over the tongue 16 and the length thereof will correspond to the folded-in part 37 of the hem to be.

After the detachment the cutting device is displaced to its inactive position and the arresting device 18 is raised so much that it will not hamper the subsequent operations.

The squeezing device 14 will maintain its pressure against the fabric, whereas the pulling carriage 12 will be displaced along the guides 15 so much that the tongue 16 extends over the conveyor track 17 such as shown in FIG. 2. The transfer carriage 24 is displaced in a direction against the conveyor track 17 at the same time as the gripper 26 is moved on the coiler plate 25 to its collecting position in which the two gripper plates 33 and 34 of the gripper will grip the folded forward end edge of the fabric.

In the next phase the transfer carriage 24 is displaced in a direction away from the conveyor track 17 and the gripper 26 is also by means of the guiding member 28 displaced a predetermined distance along the coiler plate 25 corresponding to the length of the hem and the squeezing device 14 is furthermore opened to allow the feed foller 13 to feed a length of the fabric corresponding to the length of the piece of cloth, i.e. the future sheet such as shown in FIG. 3.

The coiler plate 25 of the transfer carriage 24 is thereupon rotated 180 degrees round the axis 29, whereby the forward end portion of the plate will be located in engagement with the second conveyor track 38, such as shown in FIG. 4. The holding device 39 will now come into function and it is revolved to engagement with the coiler plate 25, whereby the future hem of the fabric 11 is pressed against the conveyor track 38.

At this squeezing the pressure plate 32 with the rubber blocks 31 is active and presses under good friction the fabric against the conveyor track 38. The forward portion of the coiler plate 25 has a surface of low friction and it might therefor be pulled out of the hem although the squeezing device exerts a pressure on the fabric.

Figure 5:
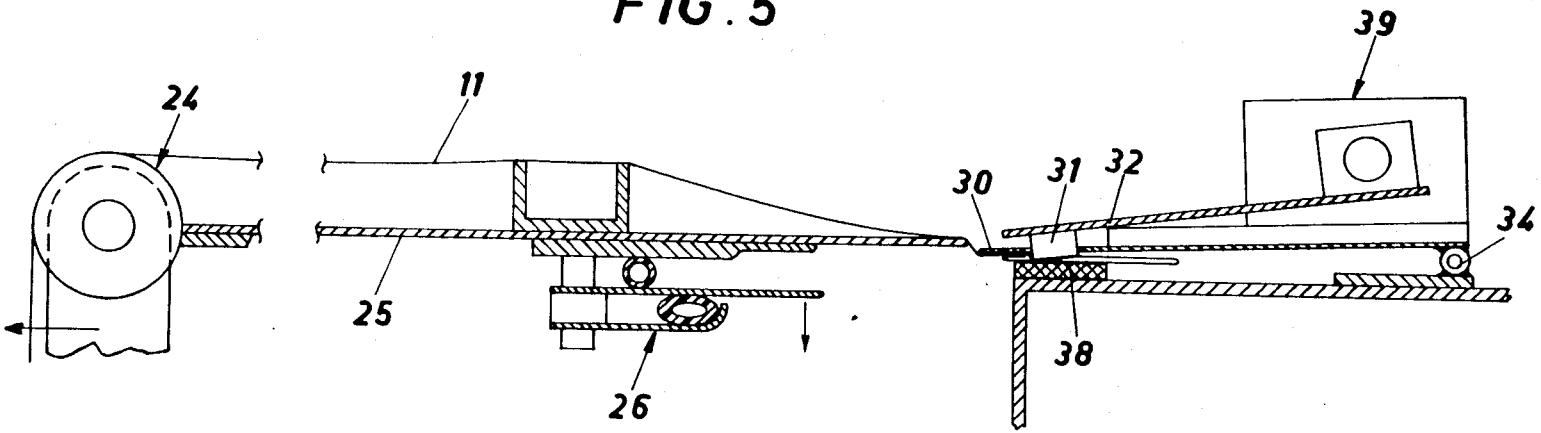
FIG. 5 shows a section analogous with FIG. 4 but the transfer carriage and the gripper are shown in a position displaced laterally and with the first holding and arresting device activated.

Prior to the transfer carriage 24 being moved in the directon away from the conveyor track 38 the gripper 26 will be opened to let free the folded in part 37. This position is shown in FIG. 5. During the transfer of the fabric 11 to the conveyor track 38 the pulling carriage 12 has returned to its initial position shown in FIG. 1, whereby, when the coiler plate has been pulled out of the hem (FIG. 5), the arresting device 18 can be put in action, whereby an inner portion of the fabric 11 is pressed to contact against the conveyor track 17. The same procedure as that is now repeated, i.e. the squeezing device 14 holds the fabric against the tongue 16, the pulling carriage 12 stretches the fabric and the cutting device 23 separates a piece of cloth from the fabric. Two en edges of the piece of cloth are pressed against the conveyor tracks 17, 38 by the presser base 22 of the presser device 20 and by the presser plate 30 of the holding device 39, whereupon both conveyor tracks is rotated synchronously, whereby the piece of cloth is conveyed in a direction against two sewing machines (not shown). On its way to those machines the rear end edge of the piece of cloth will pass a folding device of a known design, which makes the hem which has a non-variable width.

The hemming machine according to FIGS. 6–8 funtions in a similar way with the exception that the displacement movement of the gripper 26 along the coiler plate 25 is eliminated. The width of the hem is instead determined by the distance A (FIG. 7) which the coiler plate 25 projects in front of the gripper plates 33, 34.

With the metod and the device according to the invention it is thus provided a completely mechanized hemming of e.g. sheet fabric, where the width of one of the hems can be varied. It is of course realized that the invention can be modified within the scope of the claims, e.g. by combining features from the different embodiments.

I claim:

1. An apparature for mechanically folding and making hems along two opposite edges of a piece of cloth detachable from a roll of fabric, a first (17) and second (38) conveyor tracks, endless, spaced apart, and parallel;

holding (39) and arresting (18) means comprising devices cooperating with said conveyor tracks and extending over the entire width of the fabric, for squeezing portions of the fabric against said conveyor tracks;

a transfer carriage (24) provided between the two conveyor tracks (17, 38) and equipped with a horizontal coiler plate (25);

said coiler plate (25) being rotatable about a horizontal axis (29) substantially 180 degrees and having rotation means operatively associated therewith;

a fabric gripper means (26) supported upon said coiler plate (25) having gripping operating means (33, 34) associated therewith, which fabric gripper means is arranged to grip a forward end edge of the fabric when it is positioned in a first position adjacent the first conveyor track (17);

whereby when said coiler plate (25) and supported gripper means is rotated to a position on the opposite side of said horizontal axis said gripped froward end edge of the fabric is conveyed to a second position wherein it is located on the second conveyor track (38); and whereby said fabric while still engaged by said holding (39) and arresting devices (18) is conveyed by said conveyor tracks to sewing means comprising a sewing machine for each hemmed end edge.

2. The apparatus of claim 1 wherein the fabric gripper means is displaceable within the coiler plate's plane for varying the width of one of the hems.

3. The apparatus of claim 2 wherein displacement operating means are associated with said fabric gripper means and comporising said gripper means (26) on the coiler plate (25) an adjustable distance from the end edge of said coiler plate, which distance approximately corresponds to the desired width of said variable hem;

4. The apparatus of claim 1 wherein the fabric gripper means is secured to the coiler plate and the coiler plate is arranged to project a distance in front of said gripping operating means, said distance corresponding to the width of one of the hems.

5. The apparatus of claim 4, wherein the fabric gripper means is releasably secured to the coiler plate and is displaceable thereon for varying the width of said hem.

6. The apparatus of claim 1 wherein said arresting and holding devices each are provided with two sets of clamping members one set of which has a low friction and the other set of which has high friction, relative to the fabric.

7. The apparatus of claim 1 wherein the arresting and holding device comprises an endless band.

8. The apparatus of claim 1 wherein said fabric gripping means is adapted in one end position to cooperate with fabric delivery means, which forms part of a pulling carriage and which is provided with squeezing means for squeezing the fabric.

9. The apparatus of claim 8 wherein cutting means is afforded displaced between the fabric roll and the holding and arresting means cooperating with the first conveyor track, so that a predetermined length of fabric may be detached from said roll by said cutting means.

10. The apparatus of claim 9 wherein the axis of rotation of said coiler plate is within said transfer carriage and corresponds approximately to one edge of said coiler plate, and wherein said axis is at right angles to the derection of fabric motion before it is conveyed on said conveyor tracks.

11. The apparatus of claim 10 wherein a fabric feeding means is afforded, displaced between the roll of fabric and the cutting means, comprising:

a pulling carriage capable of reversible horizontal displacement in the direction of fabric feed;

means for displacing said pulling carriage operatively associated therewith;

a feed roller mounted on said pulling carriage so that the fabric moves between said feed roller and said pulling carriage;

said squeezing means being mounted upon said pulling carriage for squeezing said fabric against said pulling carriage; and delivery means comprising a delivery tongue integral with the leading edge of said pulling carriage, which tongue is adapted to support an end of the fabric which is capable of being gripped between an upper plate and a lower plate os said gripping means.

* * * * *

UNITED STATES PATENT AND TRADEMARK OFFICE

CERTIFICATE OF CORRECTION

PATENT NO. : 4,491,079

DATED : January 1, 1985

INVENTOR(S) : Pertti Gustavsson

It is certified that error appears in the above—identified patent and that said Letters Patent is hereby corrected as shown below:

On the title page add:

--Related U.S. Application Data

[63] Continuation-in-part of Serial No. 166,967, July 8, 1980, abandoned.--

Column 1, after line 7, insert:

--- Continuation-in-part of Serial No. 166,967, July 8, 1980, abandoned. ---

Signed and Sealed this

Thirtieth Day of April 1985

[SEAL]

*Attest:*

DONALD J. QUIGG

*Attesting Officer*

*Acting Commissioner of Patents and Trademarks*